US011185140B2

(12) United States Patent
Böing

(10) Patent No.: US 11,185,140 B2
(45) Date of Patent: Nov. 30, 2021

(54) POLE HANDLE

(71) Applicant: LEKISPORT AG, Baar (CH)

(72) Inventor: Tobias Böing, Grossbettlingen (DE)

(73) Assignee: LEKISPORT AG, Baar (CH)

( * ) Notice: Subject to any disclaimer, the term of this patent is extended or adjusted under 35 U.S.C. 154(b) by 153 days.

(21) Appl. No.: 16/482,914

(22) PCT Filed: Jan. 24, 2018

(86) PCT No.: PCT/EP2018/051663
§ 371 (c)(1),
(2) Date: Aug. 1, 2019

(87) PCT Pub. No.: WO2018/141599
PCT Pub. Date: Aug. 9, 2018

(65) Prior Publication Data

US 2020/0229554 A1 Jul. 23, 2020

(30) Foreign Application Priority Data

Feb. 5, 2017 (CH) ..... 00128/17
Apr. 26, 2017 (CH) ..... 00555/17

(51) Int. Cl.
*A45B 9/02* (2006.01)
*A63C 11/00* (2006.01)

(52) U.S. Cl.
CPC ..... *A45B 9/02* (2013.01); *A63C 11/00* (2013.01); *A45B 2009/025* (2013.01)

(58) Field of Classification Search
CPC ..... A45B 2009/025; A45B 9/02; A63C 11/00; A63C 11/22
(Continued)

(56) References Cited

U.S. PATENT DOCUMENTS 4,416,036 A * 11/1983 Aho ..... A63C 11/222 24/136 R
6,439,610 B1 * 8/2002 Pronzati ..... A63C 11/222 24/191
(Continued)

FOREIGN PATENT DOCUMENTS

DE 78 04 728 U1 6/1978
JP 50-98882 U 8/1975
(Continued)

OTHER PUBLICATIONS

International Search Report of PCT/EP2018/051663 dated Mar. 5, 2018.

*Primary Examiner* — James A Shriver, II
*Assistant Examiner* — Hilary L Johns
(74) *Attorney, Agent, or Firm* — Sughrue Mion, PLLC

(57) ABSTRACT

A pole handle having a fastening mechanism for a hand strap with loop strips at variable lengths with a clamping element mounted in a recess. The recess is a through-opening of which the lower opening opens within a rear handle region, and the upper opening towards the upper side of the handle. The clamping element has a lever arranged in the through-opening and a head region projecting upwards out of the recess and has a loop opening and a pressure-exerting surface. The loop strips are guided through the through-opening, past the lever, and through a loop opening of the clamping element, the free ends of the loop strips exiting at the top. The clamping element can be secured in a clamping position in which the loop strips are clamped in a releasable manner, and the clamping action can be released by the clamping element being tilted around a rotary pin.

24 Claims, 8 Drawing Sheets

(58) Field of Classification Search
USPC ..... 280/821
See application file for complete search history.

(56) References Cited

U.S. PATENT DOCUMENTS

| | | | | |
|---|---|---|---|---|
| 7,665,769 | B2 * | 2/2010 | Lenhart | A63C 11/222 280/822 |
| 2013/0048039 | A1 * | 2/2013 | Heim | A45B 9/02 135/65 |
| 2017/0231339 | A1 * | 8/2017 | Kreis | A63C 11/227 135/76 |

FOREIGN PATENT DOCUMENTS

| | | | |
|---|---|---|---|
| WO | 2009/022047 | A1 | 2/2009 |
| WO | 2011/113739 | A1 | 9/2011 |

* cited by examiner

FIG. 2a
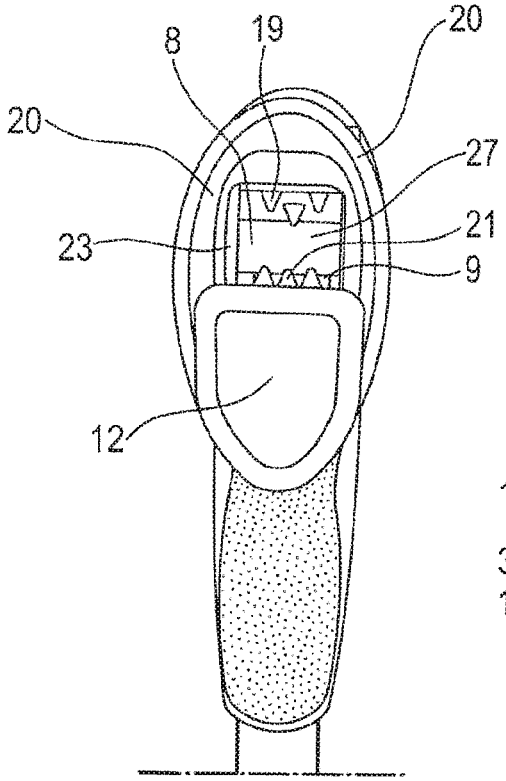
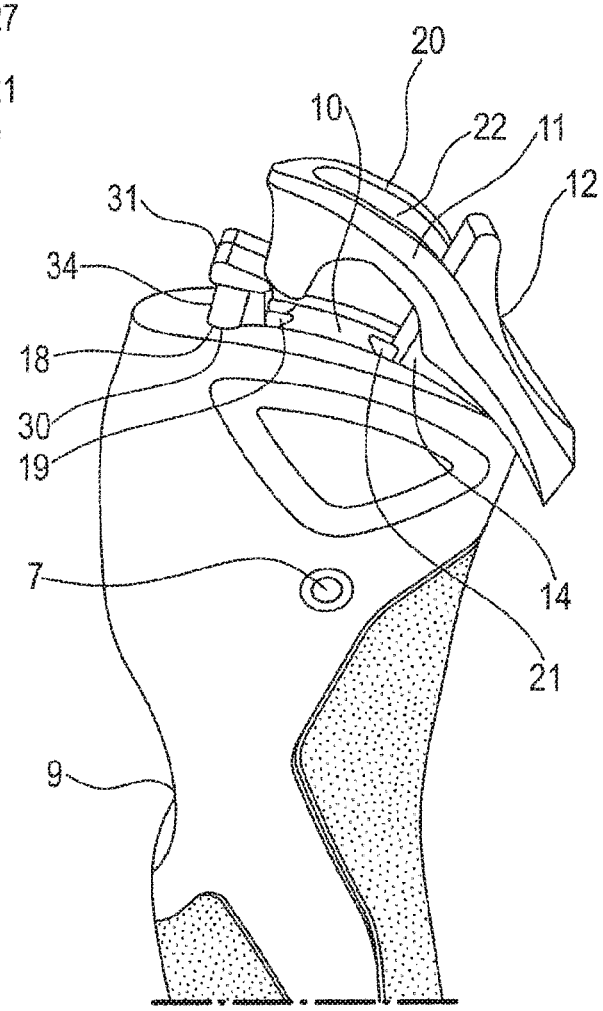
FIG. 2c
FIG. 2b
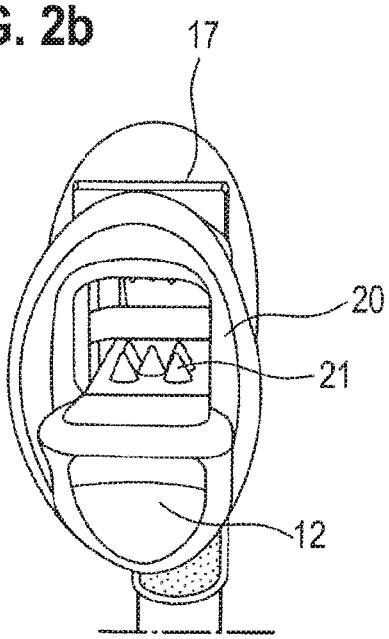

POLE HANDLE

CROSS REFERENCE TO RELATED APPLICATIONS

This application is a National Stage of International Application No. PCT/EP2018/051663 filed Jan. 24, 2018, claiming priority based on Swiss Patent Application No. 00128/17 filed Feb. 5, 2017 and Swiss Patent Application No. 00555/17 filed Apr. 26, 2017.

TECHNICAL FIELD

The present invention concerns a pole handle, in particular for a cross-country walking pole, a trekking pole, a ski pole or Nordic walking pole, with a fastening mechanism which is intended for a hand loop and makes it possible to secure the hand loop at variable lengths, wherein the fastening mechanism is arranged in a cut-out in the head region of the pole handle, and poles with such a pole handle.

PRIOR ART

Pole handles are traditionally secured to the hand of the user in that a hand loop is attached in the head region of the pole handle, the user reaches through this hand loop and then grips the pole handle through this hand loop. With such hand loops, for different hand sizes or also different usage situations, it is advantageous if the length of the hand loop can be adjusted without the need for a tool. Accordingly, there is already a multiplicity of technical implementation possibilities for designing a variable fixing of a hand loop to a pole handle.

Such fixing mechanisms should be designed as simply as possible in order to be both cheap to produce and robust during use, but at the same time they must ensure that in particular it is possible to lengthen the loop only when the corresponding fixing mechanism is actively released for adjustment.

OUTLINE OF THE INVENTION

Accordingly, it is an object of the present invention to provide an improved pole handle, in particular for a cross-country walking pole, trekking pole, ski pole or Nordic walking pole, with a fastening mechanism which is intended for a hand loop and makes it possible to secure the hand loop at variable lengths. Here, the fastening mechanism is arranged in a cut-out in the head region of the pole handle. The pole handle proposed according to the invention is in particular characterized in that the fastening mechanism comprises a clamping element which is arranged in the cut-out and mounted such that it can be rotated about a rotary shaft arranged transversely to a pole axis or pole handle axis, wherein the cut-out is configured as a passage opening which is oriented at an acute angle to the pole axis, and the lower opening of the cut-out opens towards the outside within or above a rear handle region facing towards the palm of the hand, and the upper opening opens upward towards the top of the pole handle.

Preferably, the clamping element has a lever region which is arranged substantially in the passage opening and through which the rotary shaft passes, and a head region which protrudes upward out of the cut-out of the handle, preferably with a loop opening and a pressure surface, the latter to establish the position of the hand in a clamping or fixing position in which the loop length cannot be adjusted, and in some cases also for shifting to the free position in which the loop strips are not clamped and the length can be adjusted.

Here, the loop strips are guided through the passage opening past the lever region, and—where present—through a loop opening of the clamping element, or past the head region of the clamping element, and emerge with their free ends at the top of the passage opening or loop opening.

The clamping element may thus be secured in a clamping position in which the loop strips (preferably lying directly on one another) are clamped by force fit and/or form fit between the lever region and a wall of the passage opening or a fixing element (preferably attached in or on the passage opening), in that a latching lug of the clamping element engages releasably behind a protrusion of the handle head or behind a latching protrusion of the fixing element. The latching or clamping can be released by tilting the clamping element around the rotary shaft, preferably forward in the travel direction, thus releasing the latching lug.

A first preferred embodiment is characterized in that in its head region, the clamping element comprises a curved region facing towards the hand loop and pointing towards the rear in the travel direction; the pressure surface arranged towards the front in the travel direction, wherein the curved region preferably surrounds and forms the loop opening; and at the front part of the curved region in the travel direction, the latching lug is preferably formed as a downwardly directed protrusion which, in the clamping position, engages releasably behind the protrusion of the handle head or behind the latching protrusion of the fixing element.

The curved region here may have arcuate recesses facing the handle body on both sides, which allows the optimal bending flexibility of the latching lug to be set.

The cut-out may comprise a receiving recess in the region and wall portion of the inner wall facing towards the rear in the travel direction, preferably a T-shaped recess with an open region facing the clamping element and two side widenings in which the fixing element is attached.

The fixing element may furthermore have a holding region which is inserted in the cut-out, and a latching protrusion protruding upward above the handle for the latching lug.

A further preferred embodiment is characterized in that the lever region, and/or the region and wall portion of the inner wall of the cut-out facing towards the rear in the travel direction, and/or the exposed region of the holding region of the fixing element facing the clamping element, comprise means for securing the loop strips, preferably in the form of teeth, spikes, ribs and/or a friction-reducing coating.

The pole handle may furthermore comprise a wedge in the latched position, can be inserted by friction fit and/or force fit and/or form fit between the lever region and a wall of the passage opening, so that the clamping element can no longer be swiveled into the released position. Preferably, the free ends of the loop strips are attached to this wedge.

A fixing element may be arranged in the receiving recess, wherein its front side forms a counter-pressure surface against which the retaining region directly clamps the two loop strips.

The clamping element may but need not be loaded with a reset force by an elastic return element, in particular a spring, preferably a leaf spring or a coil spring, or an elastic region of the lever region, and preferably clamped against the inner wall. For example, it is possible that the lever region is left to protrude slightly beyond the rotary shaft, and its protruding region is configured such that in the clamping position, because of material deformation, it can easily be clamped against the front boundary wall of the passage opening. As a result, on release from the clamping position, it is guaranteed that the clamping element pivots as autonomously as possible and as far as possible into the open position. It is in fact possible that teeth provided on the clamping element or on the fixed element bite into the material of the two loop strips, and it is then desirable that the movement of the clamping element into the open position is supported. The same is naturally also possible with a coil spring or leaf spring which forces the clamping element into the open position.

According to a further preferred embodiment, the rotary shaft of the clamping element passes through the lever region in the region of its lower end, transversely to the travel direction, wherein the lever region protrudes upward into the passage opening preferably by more than 30%, preferably by more than 40% of the length of the passage opening, measured at its front inner wall.

The head region may have a downwardly sloping chamfer pointing towards the front, and the upper opening may be arranged in this chamfer, and the clamping element with the pressure surface and the curved region can be accessed at least partially through the upper opening in the region of this chamfer or protrudes beyond this. This accessible region or the region protruding above this upper opening (10) may be formed as a pressure surface for manipulation for tilting, in particular into the clamping position.

The clamping element preferably comprises a widening pointing forward and downward relative to the usage direction of the pole handle, which widening at least partially, preferably substantially completely, covers the gap between the clamping element and the upper opening of the wall delimiting the cut-out, in order to prevent the penetration of dirt and/or snow and/or ice.

A further preferred embodiment is characterized in that on the underside, the handle has a recess for receiving a pole tube which may be made of several pieces. Preferably, a holding peg may be provided in the recess which engages in the interior of an inserted pole tube, and is preferably integral with the handle body.

The clamping element and/or the fixing element and/or the handle body may consist of a thermoplastic material, preferably polyamide, polyester, polyolefins, PET or mixtures thereof, in non-reinforced or glass-fiber-reinforced form. In particular in the curved region, a configuration from a material is advantageous which simultaneously allows simple but nonetheless retaining engagement in the fixing position but also is not so rigid that it can no longer be released.

The pressure region of the clamping element may preferably be delimited towards the rear in the travel direction by a protrusion which preferably runs transversely, in order to facilitate manipulation.

The lever region substantially aligns with the pressure region arranged above it, and the curved region is furthermore formed thereon, preferably towards the rear in the travel direction.

The hand loop may be a single loop, a loop which can be attached to the hand with three separate openings for thumbs, finger/back of hand, and wrist, or a glove with loop strips attached thereto.

The hand loop may be a single loop (loop strip, typically of woven textile, in particular of a dimensionally stable synthetic fabric, typically with a thickness in the range from 0.3-2 mm, and/or normally with a width in the range of 3-20 mm, preferably with a width in the range of 4-10 mm, wherein this width applies to the zone which may come to lie in the fastening region; the zones lying in the hand region may also be formed wider and in particular e.g. have soft zones stitched thereon, for example of neoprene). Alternatively, it may be a loop which can be secured to the hand with three separate openings for thumbs, finger/back of hand, and wrist. Typically, such loops are formed to be adjustable around an eyelet with a hook and loop fastening. Or it may be a glove with loop strips attached thereto.

Typically, such a pole handle has a sleeve of hard plastic which has soft layers in the handle region, wherein such elements may be produced in a two-component injection-molding process. The clamping element is preferably also made of hard plastic, wherein the above-mentioned toothing may be formed of the same material (integrally) or for example also be formed by metallic inserts or similar. The rotary shaft for the clamping element is typically made of metal or plastic or a combination thereof, and may be inserted in the sides of the cut-out through two corresponding opposite openings in the material of the handle head, after insertion of the clamping element (and in some cases the fixing element), passing through the openings in the handle head and a shaft opening in the clamping element.

Furthermore, the present invention concerns a cross-country walking pole, trekking pole, ski pole or Nordic walking pole with a pole handle as claimed in any of the preceding claims.

Further embodiments are given in the dependent claims.

BRIEF DESCRIPTION OF THE DRAWINGS

Preferred embodiments of the invention are described below with reference to the drawings which serve solely for explanation and should not be interpreted restrictively. The drawings show.

DESCRIPTION OF PREFERRED EMBODIMENTS

Figure 1A:
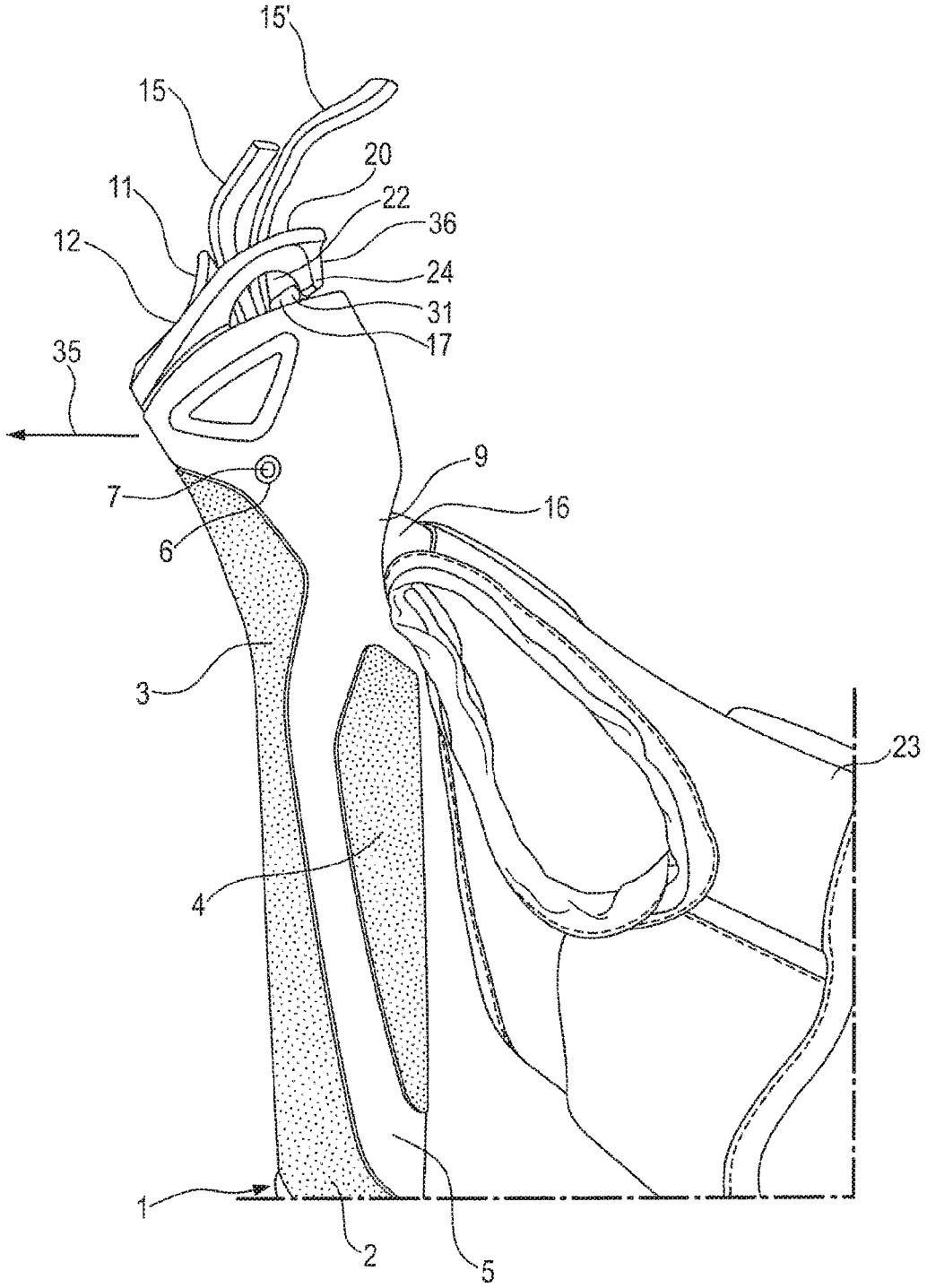
FIG. 1 a pole handle with a fixing mechanism according to the invention, showing a) a view from the side, travel direction towards the left, in which the hand loop is fixed; b) a view from the side, travel direction towards the left, in which the hand loop is released and can be adjusted in length; and c) how the fixing mechanism can be secured by hand.

FIG. 1 shows a pole handle 1 with the device according to the invention for variably setting the length of a hand loop 23. The pole handle 1 has a handle body, on the underside of which is formed a recess 2 for a pole tube. In the travel direction 35 of the handle body, which has a front handle region 3 and a rear handle region 4, some handle zones are made of cork for a better feel. The actual handle body is formed by a plastic sleeve 5 of hard plastic. The handle region 4 at the rear in the travel direction comprises, above the handle region but below the head region of the handle, an opening 9 from which the loop strips 16 of the hand loop 23 emerge from the handle head, followed by a hand loop with three openings, one for the thumb, one for the remaining fingers and one for the wrist. However, a single loop may also be attached in this way.

The two loop strips 16 pass through the handle head from the bottom, through a cut-out 8 which is open at the top, i.e. which has an upper opening 10 as well as the lower opening 9. The corresponding cut-out 8 accordingly receives the loop strips 16 from below, and these emerge with their free ends 15 and 15' from the handle head at the top. They may however also be inserted again at the top at least partially into the handle body or into the clamping device described below, in order not to be disruptive there above the handle head during use.

This linear cut-out 8, which is arranged at an acute angle to the pole axis and takes the form of a passage opening, accommodates the clamping element 11. This clamping element 11 has a shaft bore arranged transversely to the pole axis, through which a rotary shaft 7 is mounted in two shaft holes 6 arranged opposite each other in the sides of the sleeve. The clamping element 11 is mounted accordingly via this shaft 7 so as to be rotatable or pivotable over a small angular range, typically no more than 10 to 15°.

The actual clamping device comprises a clamping element 11 which is arranged in the cut-out 8 and is mounted so as to be rotatable or tiltable about a shaft 7 mounted in two opposite shaft holes 6. The clamping element 11 for this has a lever region 14 which, in its lower zone, itself comprises a passage bore through which the rotary shaft 7 passes. This lever region 14 is arranged in the handle head.

The upper part of the clamping element 11 protrudes from the handle head. The upper part comprises a pressure region 12 and a region pointing towards the rear in the travel direction 35, which comprises a curved region 20. This curved region 20 surrounds a loop opening 22 through which the two loop strips 15 pass further upward after having emerged through the cut-out 8 from below. A downwardly pointing latching lug 24 is arranged or molded on the rear part of the curved region 20 in the travel direction. This forms a guide 36 for release of the mechanism, i.e. for shifting this into the position shown in FIG. 1*b*.

On the other side, a fixing element 17 is also let into the handle head. This protrudes upward beyond the upper edge of the handle head where it provides a latching protrusion 31, behind which the latching lug 24 engages in the fixing position.

When the fixing element 17 is in the clamping position and the latching lug 25 is engaged behind the latching protrusion 31, the two loop strips 15 are clamped between the lever region 14 of the clamping device 11 and a holding region of the fixing element arranged at the bottom of the cut-out 8, so that the length of the hand loop 23 is fixed in this position.

Figure 1B:
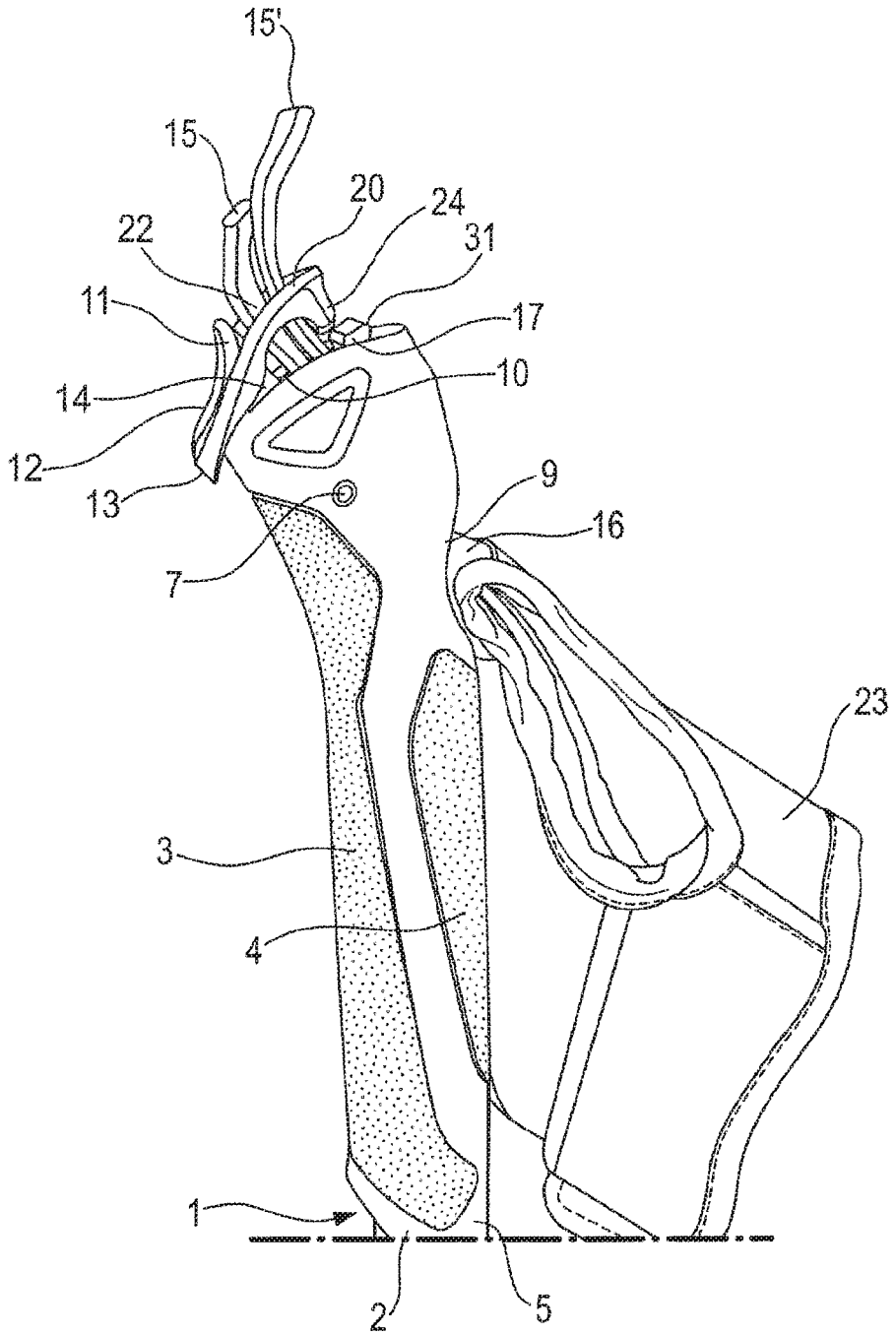

FIG. 1*b* shows the released position of this mechanism. Here, the clamping element 11 is tilted slightly forward in the travel direction, i.e. the latching lug 24 has cleared the latching protrusion 31 and has pivoted forward. Accordingly, the lever region 14 has also moved away from the inner wall arranged at the rear in the travel direction, or from the fixing element 17 arranged there, and now the two loop strips 16/15 are no longer fixed in the handle head and their length can be adjusted, i.e. they can be pushed into the handle head.

The clamping element 11 can be pushed back into the fixing position by the pressure surface 12. In order to bring the clamping mechanism from the closed position shown in FIG. 1*a* into the released position shown in FIG. 1*b*, using the thumb or even the thumb belonging to the hand which is in the hand loop, the clamping element 11 can be pushed or tilted forward by pressing in the region of the latching lug 24.

Figure 1C:
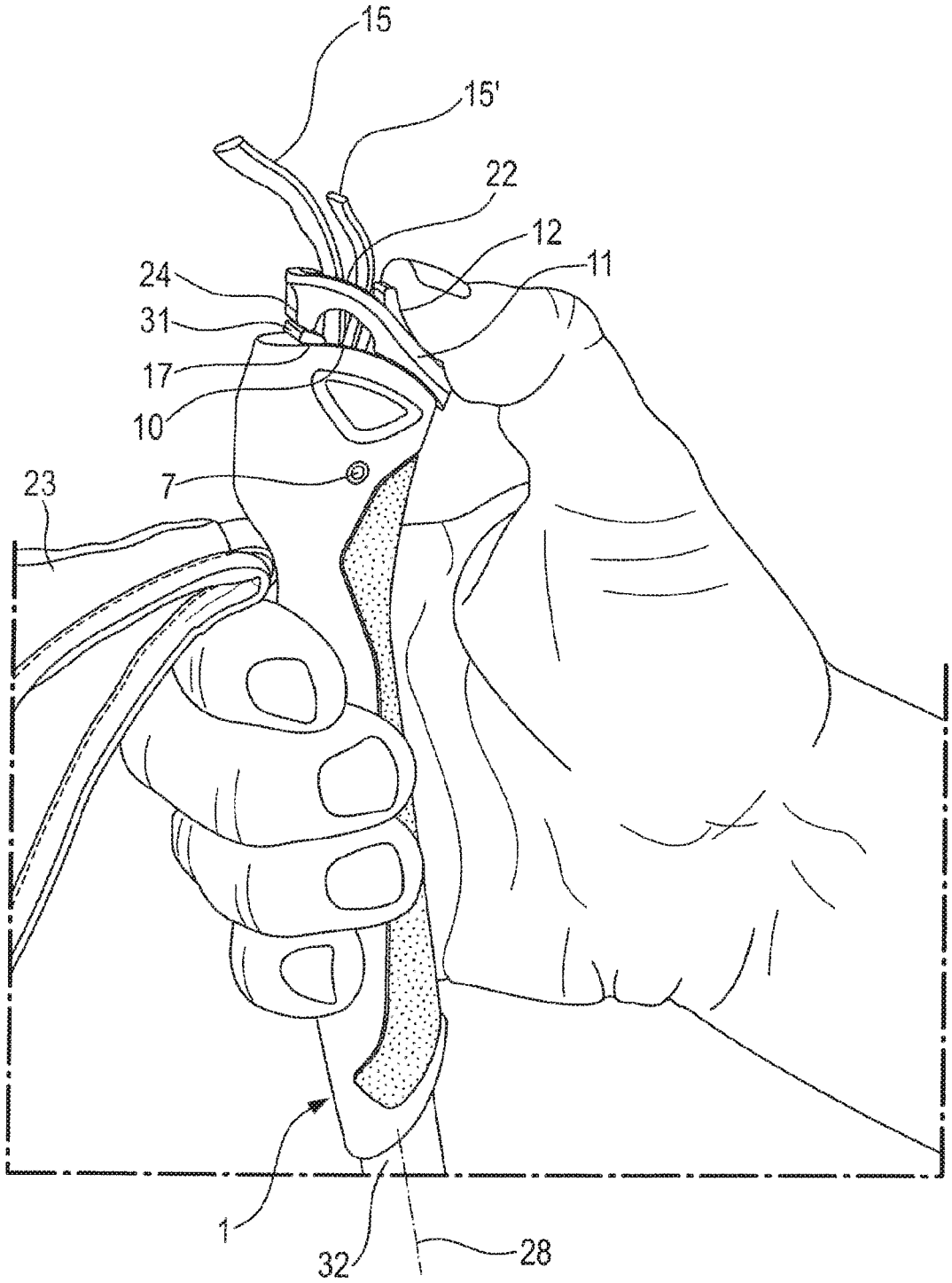

FIG. 1*c* shows how the thumb can be used to push the clamping element 11 back again by pressing on the pressure surface 12, supported by a protrusion 33, so that the latching, lug 24 can snap-engage behind the latching protrusion 31 and thus fix the two strips 16/15 in their position again.

Figure 2D:
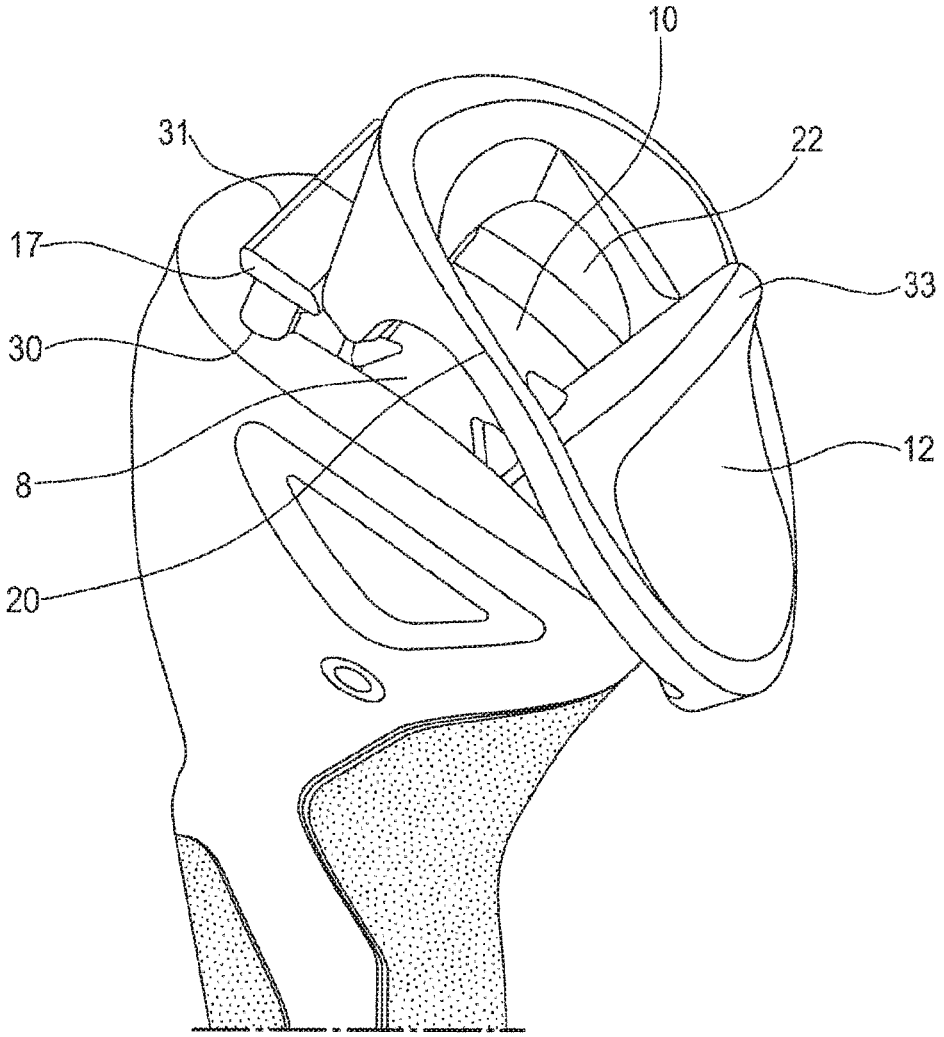
FIG. 2 the handle according to FIG. 1 with the hand loop removed, showing a) a first view into the pole handle cut-out from above, b) a second view into the pole handle cut-out from above, c) a side view wherein the counter element is slightly withdrawn upwards from the handle head, and d) a view from obliquely above in the released position, wherein the counter element is slightly withdrawn upward from the handle head.

FIG. 2 shows various views, wherein here the strips and loop have been removed to give a better view of the cut-out 8 and the elements arranged therein. FIG. 2*a* shows a view from above into the cut-out 8. The figure shows how the curved region 20 surrounds the loop opening 22, and how spikes 21 are arranged above all on the face of the lever region 14 of the clamping element 11 facing the strips for clamping the loop, so that the two loop strips are held firmly.

It should be noted that the two loops lie on top of one another in the clamping position. Accordingly, it is also advantageous if such spikes 21 are provided not only on the lever region 14 but also on the opposite face of the cut-out 8. In this exemplary embodiment, this opposing face is formed by the holding region 34 of the fixing element lying in a recess in the handle head, but it would also be possible to simply configure the recess on the inside directly in this way. This holding region 34 of the fixing element 17 also has spikes 19, i.e. each of the two loop strips lying on top of each other is retained or fixed by spikes on both sides.

FIG. 2*c* shows a side view of how the fixing element is inserted in a corresponding receiving recess 18 in the handle head. This receiving recess has two lateral widenings 30 in which corresponding widenings of the fixing element 17 engage. The fixing element 17 accordingly comprises the holding region 31 which is inserted in the handle head and is however exposed on the inside the cut-out 8 towards the loops, where it comprises said spikes 19 for clamping. On the other side, the fixing element 17 has a region 31 protruding upward beyond the handle head and providing the latching protrusion 31. Thus it is for example possible to insert such a device in a standard handle head which has a different fastening mechanism.

Figure 3:
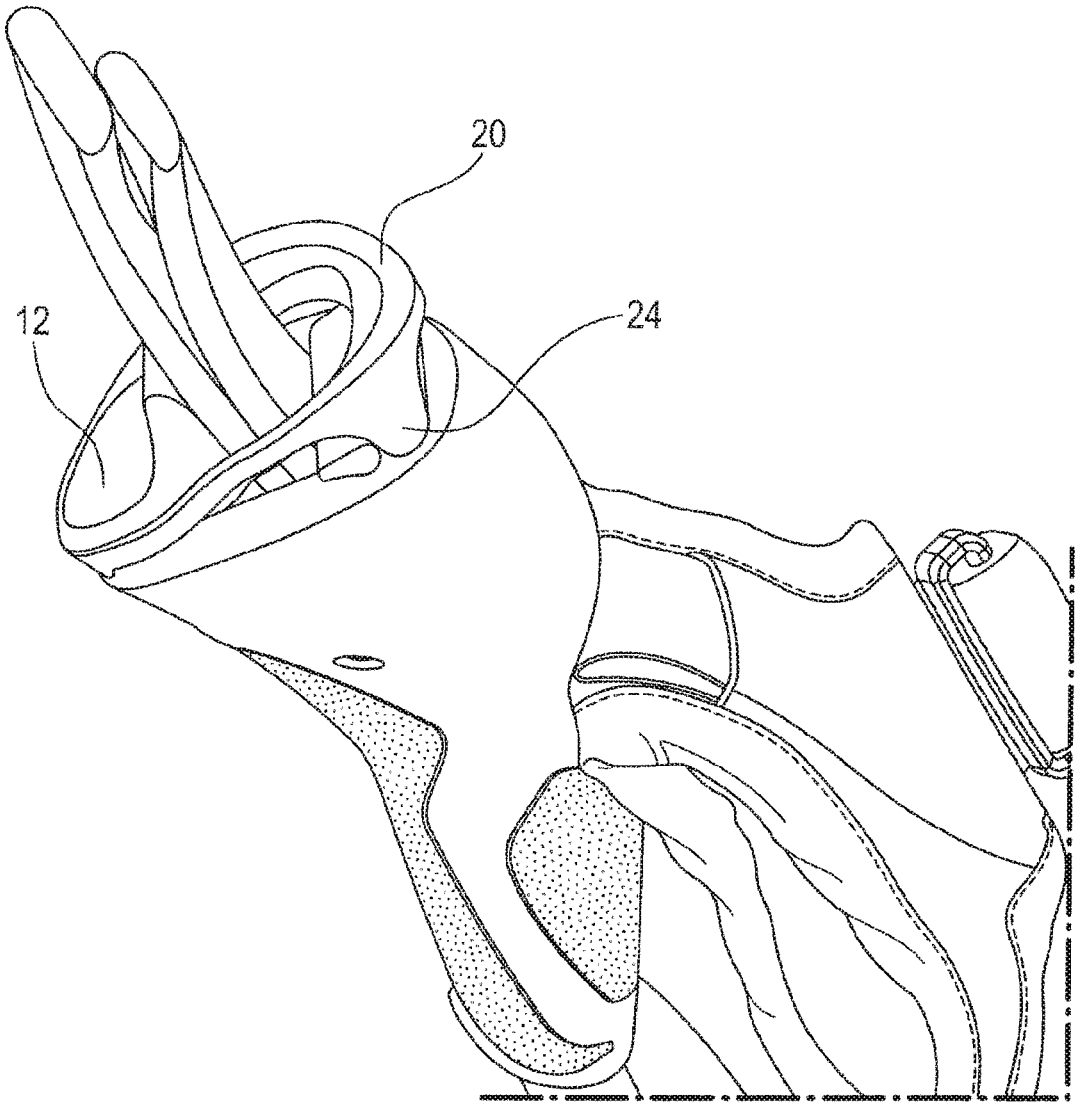
FIG. 3 the handle from FIGS. 1 and 2 with hand loop fixed, from obliquely above.

FIG. 3 shows a fixing position of such a pole. Here it is evident how the free ends of the loop strips emerge upward through the opening 22. It can also be seen how this loop opening 22 is sufficiently large for the tips of both free ends 15 to be inserted again at least partially in this loop opening 22 if desired, so they are not disruptive during use.

An advantage of this clamping method is the quasi-automatic clamping under increased tension.

One problem of such a mechanism may be the fact that in the clamped state, the region between the front inner wall 26 and the clamping element 11 must have a certain gap size in order to allow tilting. Dirt or ice or even snow can penetrate through this gap into the interior of the cut-out and permanently block or even damage the mechanism. To prevent this problem, on its front side the clamping element 18 has a lower protrusion 13 which even in clamped state extends over this gap, so that only a very narrow constant gap remains. Thus a type of labyrinth seal is provided and if the gap is selected substantially tangentially to the rotation direction about the shaft 7, the gap size may be selected very small without adversely affecting the movability of the clamping element 11. Such sealing measures may also be implemented in other ways, for example with flexible sealing lips or by groove/tongue solutions, which are possible not only in the lower region but also at the sides in the gap between the clamping element 11 and the side walls of the cut-out 8.

Figure 4:
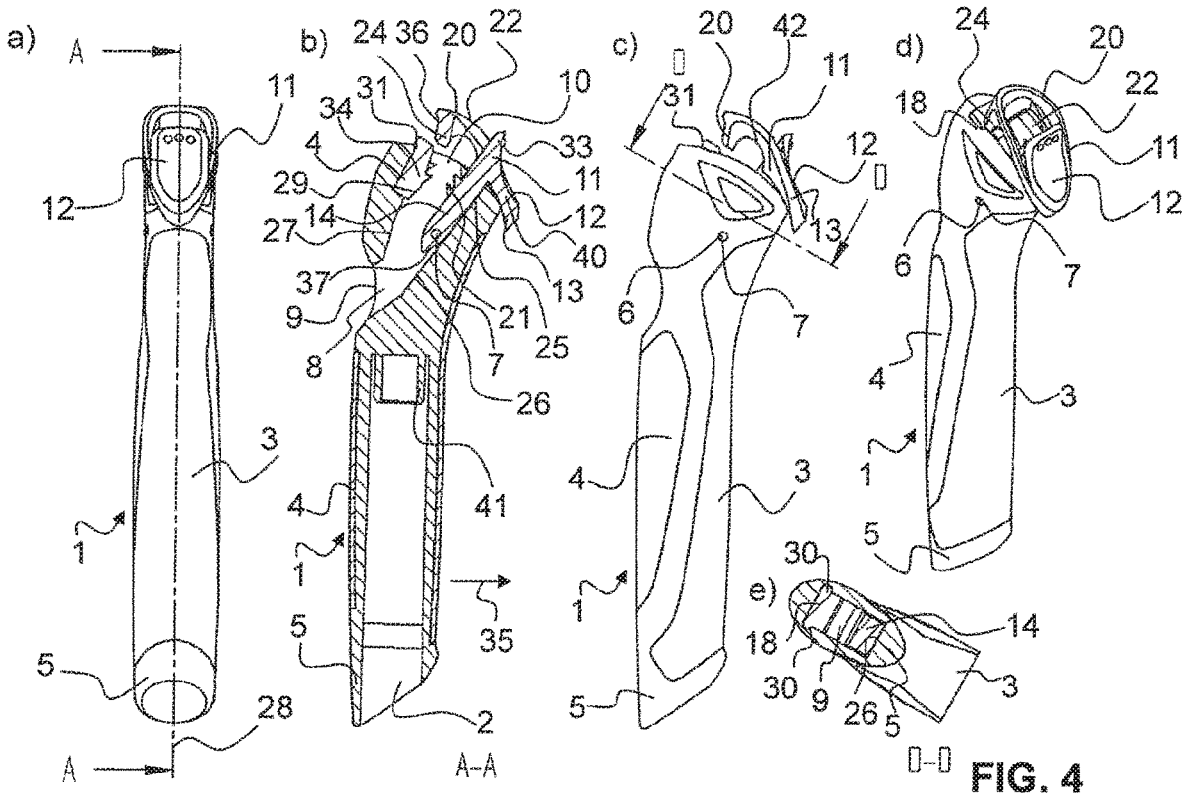
FIG. 4 a pole handle without loop strips inserted, in which the clamping device is opened, showing a) a view from the front, b) an axial section along line A-A in FIG. 4*a*), c) a side view, d) a perspective view, and e) a section along line D-D in FIG. 4*b*)
Figure 5:
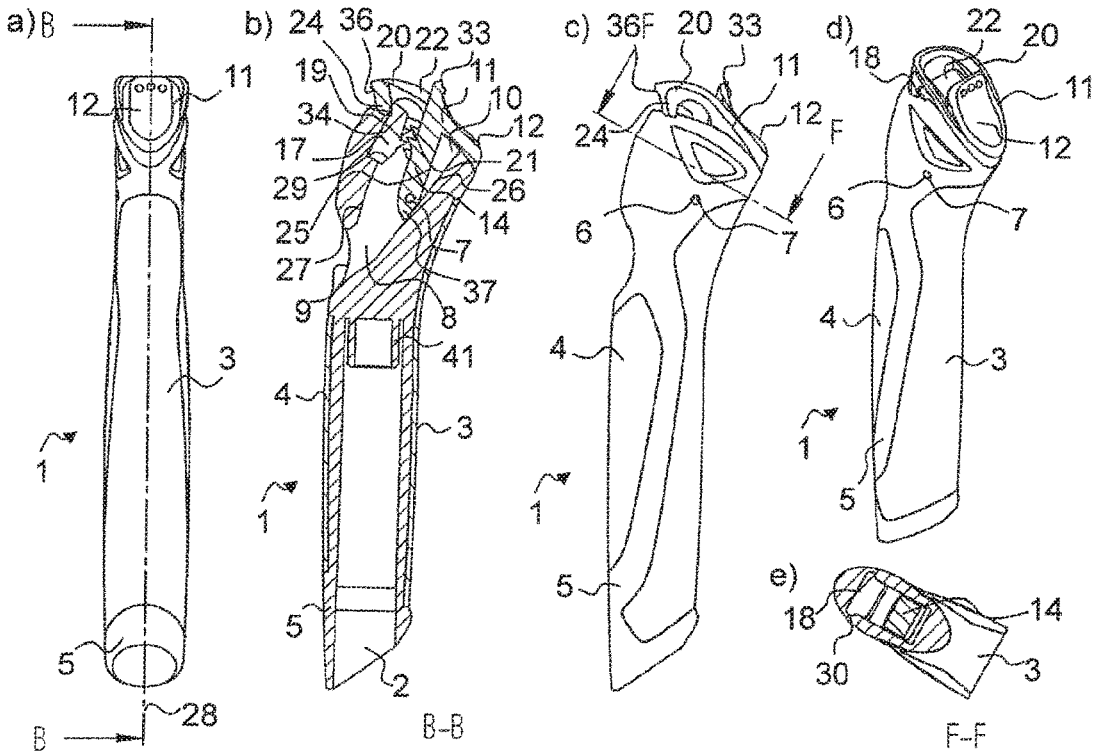
FIG. 5 a pole handle without loop strips inserted, in which the clamping device is closed, showing a) a view from the front, b) an axial section along line B-B in FIG. 5*a*), c) a side view, d) a perspective view, and e) a section along line F-F in FIG. 5*b*)
Figure 6:
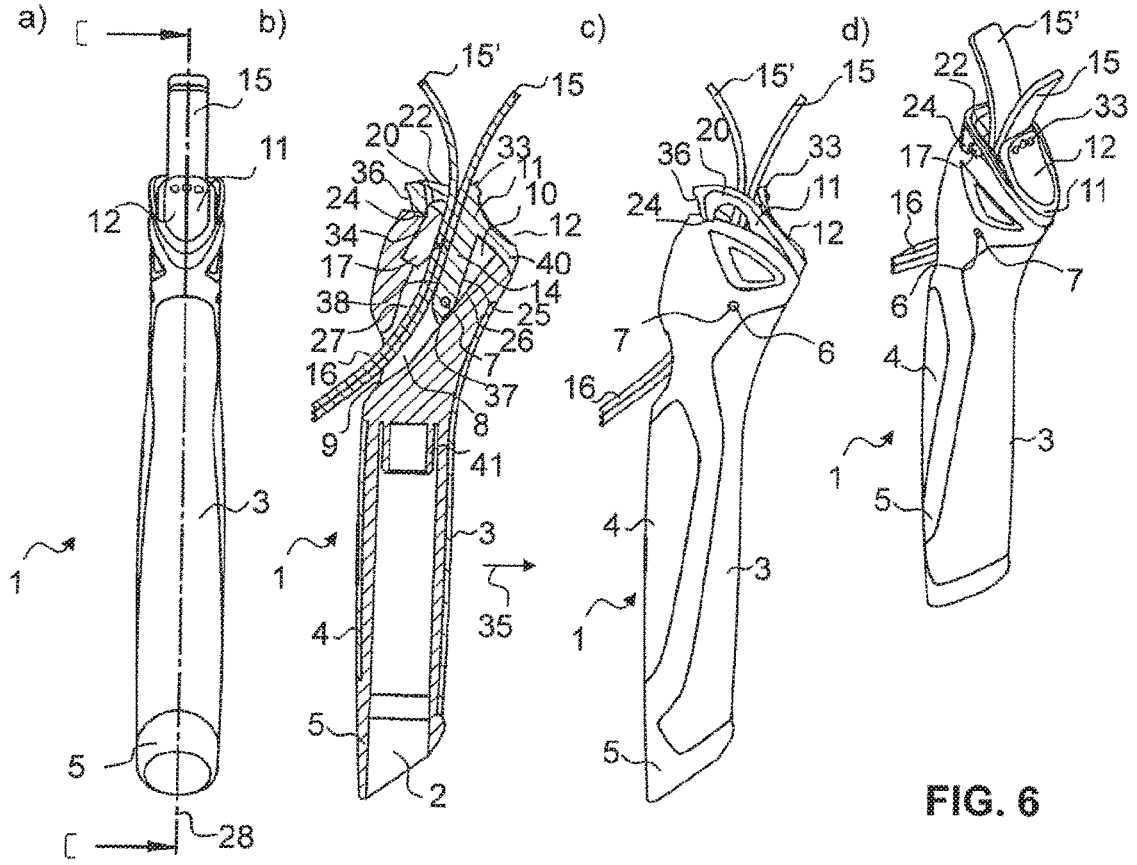
FIG. 6 a pole handle with loop strips inserted, in which the clamping device is closed, showing a) a view from the front, b) an axial section along line C-C in FIG. 6*a*), c) a side view, d) a perspective view, FIG. 7 a further exemplary embodiment, showing a) a side view, b) a pole handle head region cut along a plane running axially in the travel direction, and c) a perspective view.

FIGS. 4 to 6 show the pole handle again in more specific technical depictions. The sectional views in particular illustrate further details.

FIG. 4 shows the open position in which the clamping element 11 is tilted forward in the travel direction 35 and accordingly no clamping occurs on the loop strips (not shown in FIGS. 4 and 5). In particular, it is evident from FIG. 4*b*) how, in the pole handle head region, the cut-out has a lower opening 9 through which the loop strips enter the cut-out 8, and an upper opening 10 through which the loop strips emerge upward from the pole handle. This cut-out 8 has a front inner wall 26 and a rear inner wall 27. The clamping element comprises said lever region 14 which engages from above in the cut-out 8, and is traversed at its lower end by a rotary shaft 7 which is arranged transversely to the travel direction.

Below this rotary shaft 7 is a widening carrying reference sign 37 in FIGS. 4 to 6.

As evident in particular from FIG. 5*b*, in the clamping position, this contact region 37 comes to rest on the front inner wall 26, which results in a reset moment into the open position of the clamping element 11 when this is released from the clamping position shown in FIG. 5, in that the pressure surface 36 is pushed forward in the travel direction and perhaps slightly upward.

It can also be seen in particular from FIG. 4*c*) that the curved region which forms the loop opening 22 firstly naturally forms a type of curve to form the loop opening 22 but also has arcuate recesses 12. These arcuate recesses 42 allow the design of the rear curved region 20 with the latching lug 24 to be set optimally with regard to bending behavior, so that the latching lug 24 can engage as optimally as possible behind the latching protrusion 31 of the fixing element 17.

Also, FIGS. 4 and 5 clearly show the holding region 34 of the fixing element 17 with the teeth 19 arranged thereon. The opposite back side of the lever region 14 is also provided with toothing 21, so that the two loop strips lying on top of one another are actually secured in the tension direction without release. The toothing on both sides is important since the two loop strips lie on top of each other in this clamping region, and it is thus ensured that both loop strips are actually held in the clamping position by this additional form and not only by friction fit.

FIG. 6 and in particular FIG. 6*b*) furthermore show that, in the clamping position shown in FIG. 6, the two loop strips 15, 15' lie flat on each other in this way and are fixed by the teeth on both sides. This means that the teeth on the fixing element 17 penetrate from the rear side in the travel direction into the loop strip 15' arranged on the back, and the teeth 21 on the clamping element or on its lever region 14 penetrate into the loop strip 15 arranged on the front.

After being secured in the clamping position, the free ends of the loop strips 15, 15' may in some cases also be inserted back into the residual passage opening 22 so the protruding zones are as small as possible. This is possible thanks to the generous design of the passage opening 22 in the upper region.

Figure 7:
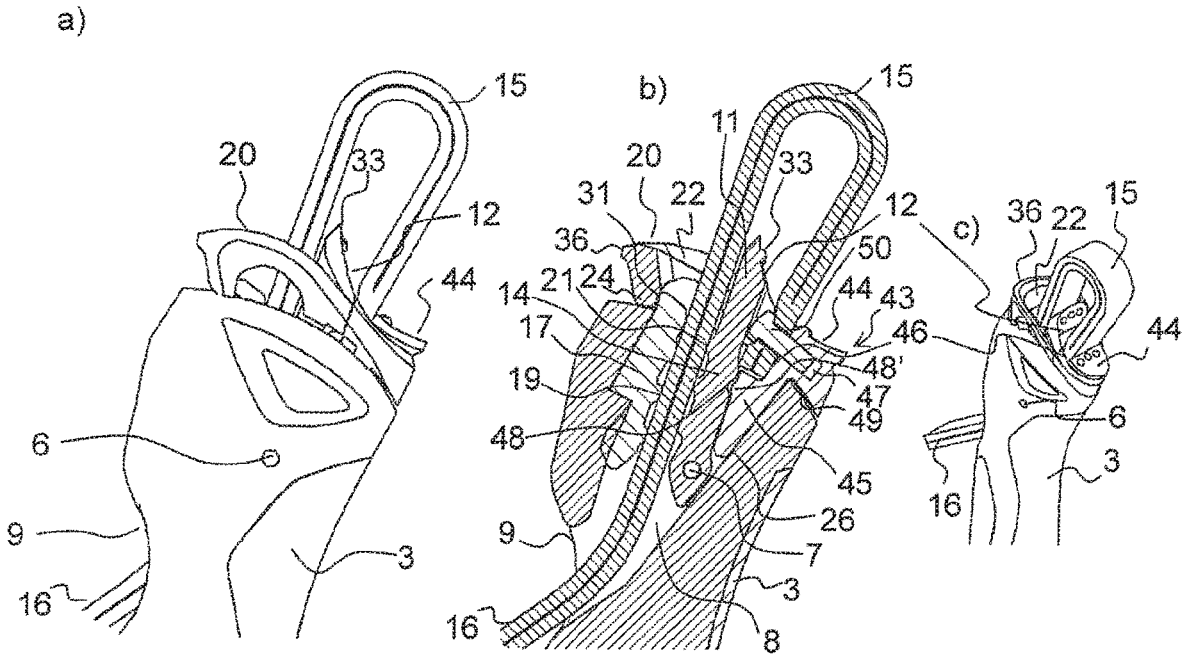

A further exemplary embodiment is shown in FIG. 7. Here the clamping mechanism may, as well as latching, also be completely secured with a wedge 43. The wedge 43 serves firstly to prevent the lever region 14 of the clamping element 11 being pivoted in the release direction. Secondly, the free ends of the loop strips protruding upward out of the clamping device can be secured on this wedge 43.

Starting from a clamping mechanism as depicted in the previous figures, in this further embodiment the front manipulation region 40 is not actually formed as part of the clamping element 11. This front manipulation region is cut away and provided with a holding region 45 at the bottom. This holding region 45 is formed as a wedge and fits into the gap formed between the lever region 14 of the clamping element 11 and the front inner wall 26 of the cut-out 8 in the region of the pole handle when the clamping element is in the fixing position.

To ensure that this wedge 43 with its holding region 45 is also held not only by friction fit in this pole handle region, the holding region 45 on the side facing the lever region 14 has a latching lug 48', and the lever region 14 has a latching groove 48 on the corresponding counter-face. The groove and lug may evidently also be arranged conversely, and there may be several such elements.

In the upper region, the wedge has a step 46 in the region facing the clamping element. A blind hole 47 is provided in this step, so that the free ends of the loop strips can be introduced into this step and secured or attached in this step by a fixing screw, a fixing rivet or pin 50, or a similar fixing element.

Furthermore, the wedge 43 on its top side has a pressing face 44 which serves to press the wedge 43 into the corresponding opening. This pressing face 44 transforms as smoothly as possible into the pressure face 12 of the clamping element 11.

If such a mechanism is to be released from the latched situation shown for example in FIG. 7*c*), it is sufficient to pull on the loop strips 15 which are guided in a curve and protrude from the top of the pole handle. Since the free ends of the loop strips 15 are secured in the step 46 of the wedge 43 via the pin 50, the wedge 43 can be withdrawn from the pole handle, releasing the groove/tongue fixing 47/48. Now the free ends of the loop strips with the wedge 43 attached thereto hang freely.

The clamping element. 11 is now free to move in the counter direction to the fixing element 17, and may for example be released by pressing on the pressure face 36, i.e. the latching lug 24 is lifted over the latching protrusion 31 and the clamping element 11 is pivoted. Then the gap between the toothed regions is released and the length of the loops can be adjusted.

If the mechanism is clamped again to establish a specific loop length, the clamping element is pivoted again by pressing on the pressure face 12, and the latching lug 24 engages over the latching protrusion 31. Then the wedge 43 is inserted and engaged in the now open gap between the lever region 14 and front inner wall 26. The loop is now completely secured and the free loop ends are tidied away.

FIG. 7 furthermore shows a special embodiment of the toothing on both the fixing element 17 and on the lever region 14 of the clamping element 11. There are three rows of teeth which are evenly distributed over the height and also slightly angled against the tension direction.

LIST OF REFERENCE SIGNS

1 Pole handle
2 Recess for pole tube
3 Front handle region
4 Rear handle region
5 Plastic sleeve of hard plastic
6 Shaft hole
7 Rotary shaft
8 Cut-out in pole handle region
9 Lower opening of 8
10 Upper opening of 8
11 Clamping element
12 Pressure face of 11
13 Lower protrusion of 11
14 Lever region of 11
15, 15' Loop strips, upper free ends
16 Loop strips, lower exit region
17 Fixing element
18 Receiving recess, T-shaped recess for 17 in 5
19 Toothing/spikes in 17
20 Rear curved region of 11
21 Toothing/spikes on 11
22 Loop opening on 11
23 Hand loop
24 Latching lug of 11
25 Front face of 14
26 Front inner wall of 8
27 Rear inner wall of 8
28 Pole axis
29 Front side of 17
30 Side widenings of 18
31 Latching protrusion of 17
32 Pole tube
33 Protrusion of 12
34 Holding region of 17
35 Travel direction
36 Pressure surface for releasing the clamp
37 Lower contact region of 14
38 Rear face of 14
40 Front manipulation region of 11
41 Holding peg
42 Concave lower edge of 20, arcuate recesses in 22
43 Fixing wedge
44 Pressing face of 43
45 Holding region of 43
46 Step for loop ends
47 Blind hole for fixing peg/pin for loop ends
48 Latching groove in 14
48'Latching lug in 45
49 Stop of 43
50 Fixing element/screw

The invention claimed is:

1. A pole handle, having a fastening mechanism which is intended for a hand loop and allows to secure the hand loop with loop strips at variable lengths, wherein the fastening mechanism is arranged in a cut-out in a head region of the pole handle, wherein the fastening mechanism comprises a clamping element which is arranged in the cut-out and is mounted such that it can be rotated about a rotary shaft arranged transversely to a pole axis or pole-handle axis, wherein the cut-out is configured as a passage opening which is oriented at an acute angle to the pole axis and a lower opening of which opens towards the outside within or above a rear handle region facing towards a palm of a hand, and an upper opening opens upward towards a top of the pole handle, wherein the clamping element has a lever region which is arranged substantially in the passage opening and through which the rotary shaft passes, and a head region which protrudes upwards out of the cut-out of the handle and has a pressure surface, wherein the loop strips are guided through the passage opening, past the lever region, and through a loop opening of the head region of the clamping element, or past the head region of the clamping element, and emerge with their free ends at the top of the pole handle or the loop opening, wherein the clamping element can be secured in a clamping position in which the loop strips are clamped by at least one of force fit or form fit between the lever region and a wall of the passage opening or a fixing element, in that a latching lug of the clamping element engages releasably behind a protrusion of the handle head or behind a latching protrusion of the fixing element, wherein a latching of the clamping position can be released by tilting the clamping element around the rotary shaft, thus releasing the latching lug, and wherein the fixing element has a holding region which is inserted in the recess, and a latching protrusion protruding upward above the handle for the latching lug.

2. The pole handle as claimed in claim 1, wherein in the head region, the clamping element comprises a curved region facing the hand loop and pointing rearwardly in a travel direction, and the pressure surface arranged frontwardly in the travel direction, wherein the curved region surrounds and forms the loop opening, and at the front part of the curved region in the travel direction, the latching lug is formed as a downwardly directed protrusion which, in the clamping position, engages releasably behind the protrusion of the handle head or behind the latching protrusion of the fixing element.

3. The pole handle as claimed in claim 1, wherein the cut-out comprises a receiving recess in the region and wall portion of the inner wall facing towards the rear in the travel direction.

4. The pole handle as claimed in claim 1, wherein the fixing element is arranged in the receiving recess, the front side of which element forms a counter pressure-surface against which the retaining region directly clamps the two loop strips.

5. The pole handle as claimed in claim 1, wherein the clamping element is clamped against the inner wall by an elastic return element, or wherein the rotary shaft of the clamping element passes through the lever region in the region of its lower end, transversely to the travel direction.

6. The pole handle as claimed in claim 1, wherein the head region has a downwardly sloping chamfer pointing towards the front, wherein the upper opening is arranged in this chamfer, and wherein the clamping element with the pressure surface and the curved region can be accessed at least partially through the upper opening in the region of this chamfer or protrudes beyond this, and that in this accessible region or the region protruding above this upper opening, is formed as a pressure surface for manipulation for tilting.

7. The pole handle as claimed in claim 1, wherein the clamping element comprises a widening pointing forward and downward relative to the usage direction of the pole handle, which widening at least partially covers a gap between the clamping element and the upper opening of the wall delimiting the cut-out, in order to prevent the penetration of dirt or snow or ice.

8. The pole handle as claimed in claim 1, wherein on an underside it has a recess for receiving a pole tube.

9. The pole handle as claimed in claim 1, wherein at least one of the clamping element or the fixing element or the handle body consist of a thermoplastic material, in non-reinforced or glass-fiber-reinforced form.

10. The pole handle as claimed in claim 1, wherein the pressure region is delimited towards the rear in the travel direction by the protrusion.

11. The pole handle as claimed in claim 1, wherein the lever region substantially aligns with the pressure region, and the curved region is formed thereon towards the rear in the travel direction.

12. The pole handle as claimed in claim 1, wherein the hand loop is a single loop, a loop which can be attached to the hand with three separate openings for thumbs, finger/back of hand, and wrist, or a glove with loop strips attached thereto.

13. A cross-country walking pole, trekking pole, ski pole or Nordic walking pole with a pole handle as claimed in claim 1.

14. The pole handle as claimed in claim 1, wherein the pole handle is for a cross-country walking pole, trekking pole, ski pole or Nordic walking pole.

15. The pole handle as claimed in claim 1, wherein at least one of the lever region, or the region and wall portion of the inner wall of the cut-out facing towards the rear in the travel direction, or the exposed region of the holding region of the fixing element facing the clamping element, comprise means for securing the loop strips, in the form of teeth, spikes, ribs and/or a friction-reducing coating, or wherein the pole handle furthermore comprises a wedge which, in the latched position, can be inserted by at least one friction fit or force fit or form fit between the lever region and a wall of the passage opening, so that the clamping element can no longer be swiveled into the released position, wherein the free ends of the loop strips are attached to this wedge.

16. The pole handle as claimed in claim 1, wherein the head region has a downwardly sloping chamfer pointing towards the front, wherein the upper opening is arranged in this chamfer, and wherein the clamping element with the pressure surface and the curved region can be accessed at least partially through the upper opening in the region of this chamfer or protrudes beyond this, and wherein in this accessible region or the region protruding above this upper opening, is formed as a pressure surface for manipulation for tilting into the clamping position.

17. The pole handle as claimed in claim 1, wherein the clamping element comprises a widening pointing forward and downward relative to the usage direction of the pole handle, which widening substantially completely covers a gap between the clamping element and the upper opening of the wall delimiting the cut-out, in order to prevent the penetration of dirt or snow or ice.

18. The pole handle as claimed in claim 1, wherein on an underside it has a recess for receiving a pole tube, wherein a holding peg is provided in the recess which engages in the interior of an inserted pole tube, and is integral with the handle body.

19. The pole handle as claimed in claim 1, wherein at least one of the clamping element or the fixing element or the handle body consist of a thermoplastic material selected from the group consisting of polyamide, polyester, polyolefins, PET or mixtures thereof, in non-reinforced or glass-fiber-reinforced form.

20. The pole handle as claimed in claim 1, wherein the pressure region is delimited towards the rear in the travel direction by a protrusion which runs transversely.

21. A pole handle, having a fastening mechanism which is intended for a hand loop and allows to secure the hand loop with loop strips at variable lengths, wherein the fastening mechanism is arranged in a cut-out in a head region of the pole handle, wherein the fastening mechanism comprises a clamping element which is arranged in the cut-out and is mounted such that it can be rotated about a rotary shaft arranged transversely to a pole axis or pole-handle axis, wherein the cut-out is configured as a passage opening which is oriented at an acute angle to the pole axis and a lower opening of which opens towards the outside within or above a rear handle region facing towards a palm of a hand, and an upper opening opens upward towards a top of the pole handle, wherein the clamping element has a lever region which is arranged substantially in the passage opening and through which the rotary shaft passes, and a head region which protrudes upwards out of the cut-out of the handle and has a pressure surface, wherein the loop strips are guided through the passage opening, past the lever region, and through a loop opening of the head region of the clamping element, or past the head region of the clamping element, and emerge with their free ends at the top of the pole handle or the loop opening, wherein the clamping element can be secured in a clamping position in which the loop strips are clamped by at least one of force fit or form fit between the lever region and a wall of the passage opening or a fixing element, in that a latching lug of the clamping element engages releasably behind a protrusion of the handle head or behind a latching protrusion of the fixing element, wherein a latching of the clamping position can be released by tilting the clamping element around the rotary shaft, thus releasing the latching lug, and, wherein at least one of the lever region, or the region and wall portion of the inner wall of the cut-out facing towards the rear in the travel direction, or the exposed region of the holding region of the fixing element facing the clamping element, comprise means for securing the loop strips, or wherein the pole handle furthermore comprises a wedge which, in the latched position, can be inserted by at least one of a friction fit or force fit or form fit between the lever region and a wall of the passage opening, so that the clamping element can no longer be swiveled into the released position.

22. A pole handle, having a fastening mechanism which is intended for a hand loop and allows to secure the hand loop with loop strips at variable lengths, wherein the fastening mechanism is arranged in a cut-out in a head region of the pole handle, wherein the fastening mechanism comprises a clamping element which is arranged in the cut-out and is mounted such that it can be rotated about a rotary shaft arranged transversely to a pole axis or pole-handle axis, wherein the cut-out is configured as a passage opening which is oriented at an acute angle to the pole axis and a lower opening of which opens towards the outside within or above a rear handle region facing towards a palm of a hand, and an upper opening opens upward towards a top of the pole handle, wherein the clamping element has a lever region which is arranged substantially in the passage opening and through which the rotary shaft passes, and a head region which protrudes upwards out of the cut-out of the handle and has a pressure surface, wherein the loop strips are guided through the passage opening, past the lever region, and through a loop opening of the head region of the clamping element, or past the head region of the clamping element, and emerge with their free ends at the top of the pole handle or the loop opening, wherein the clamping element can be secured in a clamping position in which the loop strips are clamped by at least one of force fit or form fit between the lever region and a wall of the passage opening or a fixing element, in that a latching lug of the clamping element engages releasably behind a protrusion of the handle head or behind a latching protrusion of the fixing element, wherein a latching of the clamping position can be released by tilting the clamping element around the rotary shaft, thus releasing the latching lug, and, wherein in its head region, the clamping element comprises a curved region facing the hand loop and pointing towards the rear in the travel direction, and the pressure surface arranged towards the front in the travel direction, wherein the curved region surrounds and forms the loop opening, and at the front part of the curved region in the travel direction, the latching lug is formed as a downwardly directed protrusion which, in the clamping position, engages releasably behind the protrusion of the handle head or behind the latching protrusion of the fixing element, wherein the curved region has arcuate recesses facing the handle body on both sides.

23. A pole handle, having a fastening mechanism which is intended for a hand loop and allows to secure the hand loop with loop strips at variable lengths, wherein the fastening mechanism is arranged in a cut-out in a head region of the pole handle, wherein the fastening mechanism comprises a clamping element which is arranged in the cut-out and is mounted such that it can be rotated about a rotary shaft arranged transversely to a pole axis or pole-handle axis, wherein the cut-out is configured as a passage opening which is oriented at an acute angle to the pole axis and a lower opening of which opens towards the outside within or above a rear handle region facing towards a palm of a hand, and an upper opening opens upward towards a top of the pole handle, wherein the clamping element has a lever region which is arranged substantially in the passage opening and through which the rotary shaft passes, and a head region which protrudes upwards out of the cut-out of the handle and has a pressure surface, wherein the loop strips are guided through the passage opening, past the lever region, and through a loop opening of the head region of the clamping element, or past the head region of the clamping element, and emerge with their free ends at the top of the pole handle or the loop opening, wherein the clamping element can be secured in a clamping position in which the loop strips are clamped by at least one of force fit or form fit between the lever region and a wall of the passage opening or a fixing element, in that a latching lug of the clamping element engages releasably behind a protrusion of the handle head or behind a latching protrusion of the fixing element, wherein a latching of the clamping position can be released by tilting the clamping element around the rotary shaft, thus releasing the latching lug, and, wherein the cut-out comprises a receiving recess in the region and wall portion of the inner wall facing towards the rear in the travel direction, in the form of a T-shaped recess with an open region facing the clamping element and two side widenings in which the fixing element is attached.

24. A pole handle, having a fastening mechanism which is intended for a hand loop and allows to secure the hand loop with loop strips at variable lengths, wherein the fastening mechanism is arranged in a cut-out in a head region of the pole handle, wherein the fastening mechanism comprises a clamping element which is arranged in the cut-out and is mounted such that it can be rotated about a rotary shaft arranged transversely to a pole axis or pole-handle axis, wherein the cut-out is configured as a passage opening which is oriented at an acute angle to the pole axis and a lower opening of which opens towards the outside within or above a rear handle region facing towards a palm of a hand, and an upper opening opens upward towards a top of the pole handle, wherein the clamping element has a lever region which is arranged substantially in the passage opening and through which the rotary shaft passes, and a head region which protrudes upwards out of the cut-out of the handle and has a pressure surface, wherein the loop strips are guided through the passage opening, past the lever region, and through a loop opening of the head region of the clamping element, or past the head region of the clamping element, and emerge with their free ends at the top of the pole handle or the loop opening, wherein the clamping element can be secured in a clamping position in which the loop strips are clamped by at least one of force fit or form fit between the lever region and a wall of the passage opening or a fixing element, in that a latching lug of the clamping element engages releasably behind a protrusion of the handle head or behind a latching protrusion of the fixing element, wherein a latching of the clamping position can be released by tilting the clamping element around the rotary shaft, thus releasing the latching lug, and, wherein the clamping element is clamped against the inner wall by an elastic return element, in the form of a spring, including a leaf spring or a coil spring, or an elastic region of the lever region, or wherein the rotary shaft of the clamping element passes through the lever region in the region of its lower end, transversely to the travel direction, wherein the lever region protrudes upward into the passage opening by more than 30%, or by more than 40% of the length of the passage opening, measured at its front inner wall.

* * * * *